US005617959A

United States Patent [19]

Klein et al.

[11] Patent Number: 5,617,959

[45] Date of Patent: Apr. 8, 1997

[54] SHOE RACK

[75] Inventors: Richard B. Klein, Overland Park; Chris Serslev, Leawood, both of Kans.

[73] Assignee: Lynk, Inc., Shawnee Mission, Kans.

[21] Appl. No.: 452,314

[22] Filed: May 26, 1995

[51] Int. Cl.[6] ..... A47F 7/08

[52] U.S. Cl. ..... 211/37; 211/34

[58] Field of Search ..... 211/37, 34, 35, 211/36, 38, 123, 194

[56] References Cited

U.S. PATENT DOCUMENTS

| | | | |
|---|---|---|---|
| D. 324,787 | 3/1992 | Evans | 211/34 X |
| 632,409 | 9/1899 | Hallowell | 211/35 |
| 953,130 | 3/1910 | Fellows | 211/35 |
| 1,674,359 | 6/1928 | Frey | 211/51 |
| 1,733,487 | 10/1929 | Hackley | 211/35 |
| 2,008,748 | 7/1935 | Crow | 211/34 |
| 2,067,095 | 1/1937 | Pease | 211/34 |
| 2,137,029 | 11/1938 | Scholl | 211/37 |
| 2,620,929 | 12/1952 | Sportsman | 211/43 X |
| 3,171,542 | 3/1965 | Jacobs et al. | 211/43 |
| 3,391,793 | 7/1968 | Streuli | 211/43 |
| 3,888,353 | 6/1975 | Leifheit | 211/37 |
| 3,999,734 | 12/1976 | Gibson et al. | 248/460 |
| 4,245,746 | 1/1981 | Aylor | 211/40 |
| 4,383,722 | 5/1983 | Weber | 211/37 X |
| 5,035,332 | 7/1991 | Stravitz | 211/40 |
| 5,082,125 | 1/1992 | Ninni | 211/184 |
| 5,172,816 | 12/1992 | Kline et al. | 211/37 |
| 5,415,297 | 5/1995 | Klein et al. | 211/194 X |

FOREIGN PATENT DOCUMENTS

| | | | |
|---|---|---|---|
| 530454 | 8/1954 | Belgium | 211/38 |
| 1462095 | 11/1966 | France | 211/37 |
| 182925 | 5/1936 | Switzerland | 211/35 |
| 421425 | 3/1967 | Switzerland | 211/37 |

*Primary Examiner*—Ramon O. Ramirez
*Assistant Examiner*—Sandra Snapp
*Attorney, Agent, or Firm*—Kokjer, Kircher, Bowman & Johnson

[57] ABSTRACT

A shoe rack is provided that includes a pair of side frames configured in a substantially rectangular shape. Each side frame includes a plurality of V-shaped support members containing two intersecting support bars. Each support bar within a support member includes a recess at its base to receive one support rod and recesses at the opposite end of each support member to receive a second support bar. The second support bar is moved between the recess pair in upper support members to the recess pair in the lower support members depending upon the alignment of the shoe rack horizontally or vertically. Each side frame includes a plurality of support members to support a plurality of rod pairs for storing a large number of shoes.

19 Claims, 2 Drawing Sheets

SHOE RACK

BACKGROUND OF THE INVENTION

1. Field of the Invention

The present invention relates in general to a rack for storing shoes, and in particular, to a rack which is convertible between horizonal and vertical alignments.

2. Description of the Related Art

Numerous types of racks have been proposed for storing shoes and footwear. One such rack is disclosed in U.S. Pat. No. 5,172,816. The '816 patent discloses a modular shoe rack consisting of a pair of rods extending between and supported by a pair of side frames. The side frames are generally rectangular in configuration and are arranged to be stackable upon one another in order to arrange a plurality of shoe racks in a vertical alignment. The '816 patent is incorporated herein by reference.

The shoe rack of the '816 patent is further configured to allow a plurality of rod pairs to be mounted upon opposite sides of each rectangular side frame in order that a plurality of the rod pairs extend side-by-side. While the modular arrangement of the '816 patent afforded a multi-tiered structure, it required the use of multiple modular shoe racks which are less stable than an integral design. The modules disengage one another when excessive forces are exerted upon the rack, such as when a user accidently bumps or kicks the rack. The modular design is also less cost effective in production, materials, and packaging than an integral design. Thus, an integral structure is preferable for large quantities of shoes.

In certain instances, it is desirable to use a horizontally aligned shoe rack having a plurality of shoe receiving tiers aligned front-to-back across the floor. Such a horizontally alignment is preferable when the shoes are to be placed in an area having low clearance, such as under a bed or under long-hanging clothes within a closet. In alternative situations, it may be preferable to have a vertical shoe alignment with a plurality of shoe receiving tiers aligned on top of one another.

However, the conventional shoe racks which hold multiple tiers of shoes and have an integral rigid structure have only proven useful in one orientation. This limited usefulness is due to the fact that the support bars, upon which a shoe rests, must form a minimum angle with respect to horizontal in order to allow multiple rows of shoes to be stored adjacent to one another in an overlapping space-economizing manner. Further, the angle at which the shoes rest upon the support bars must be below a maximum pitch, otherwise the shoes fall off of the rack. In view of the foregoing considerations, an optimal pitch exists for aligning the rods that support the shoes.

Heretofore, a shoe rack has been proposed having a vertical alignment with a plurality of shoe supporting tiers stacked on top of one another. However, when this shoe rack is rotated to a horizontal alignment, the pitch between the supporting rods is unduly steep. Thus, the shoes tend to fall off of the rack. Similarly, when a shoe rack is configured horizontally to include a plurality of shoe supporting rod pairs aligned front-to-back, this shoe rack is inoperative when aligned in a vertical arrangement. Since the optimal pitch between rod pairs when aligned horizontally reverts to an overly steep pitch when the rack is rotated to a vertical alignment. Hence, shoe racks configured for a horizontal alignment are not useful when rotated to a vertical alignment and vice versa.

Thus, a need remains within the industry for a convertible shoe rack which may be rotated between horizontal and vertical alignment. It is an object of the present invention to meet this need.

SUMMARY OF THE INVENTION

It is an object of the present invention to provide a shoe rack having a plurality of shoe-supporting tiers which may be aligned in horizontal and vertical alignments while maintaining the support rods within each tier at an optimal pitch.

It is a further object of the present invention to provide a shoe rack in which the pitch formed between the shoe support rods within a supporting rod pair is convertible based upon a horizontal or vertical alignment of the shoe rack.

It is a further object of the present invention to provide a shoe rack capable of maintaining shoes at an optimal pitch regardless of whether the rack is aligned horizontally or vertically.

These and other objects are achieved by a shoe rack including a pair of side frames configured in a substantially rectangular shape. Each side frame includes a plurality of V-shaped support members containing two intersecting support bars. Each support bar within a support member includes a recess at its base to receive one support rod and recesses at the opposite end of each support member to receive a second support bar. The second support bar is moved between the recess pair in upper support members to the recess pair in the lower support members depending upon the alignment of the shoe rack horizontally or vertically. Each side frame includes a plurality of support members to support a plurality of rod pairs for storing a large number of shoes.

DETAILED DESCRIPTION OF THE INVENTION

Figure 1:
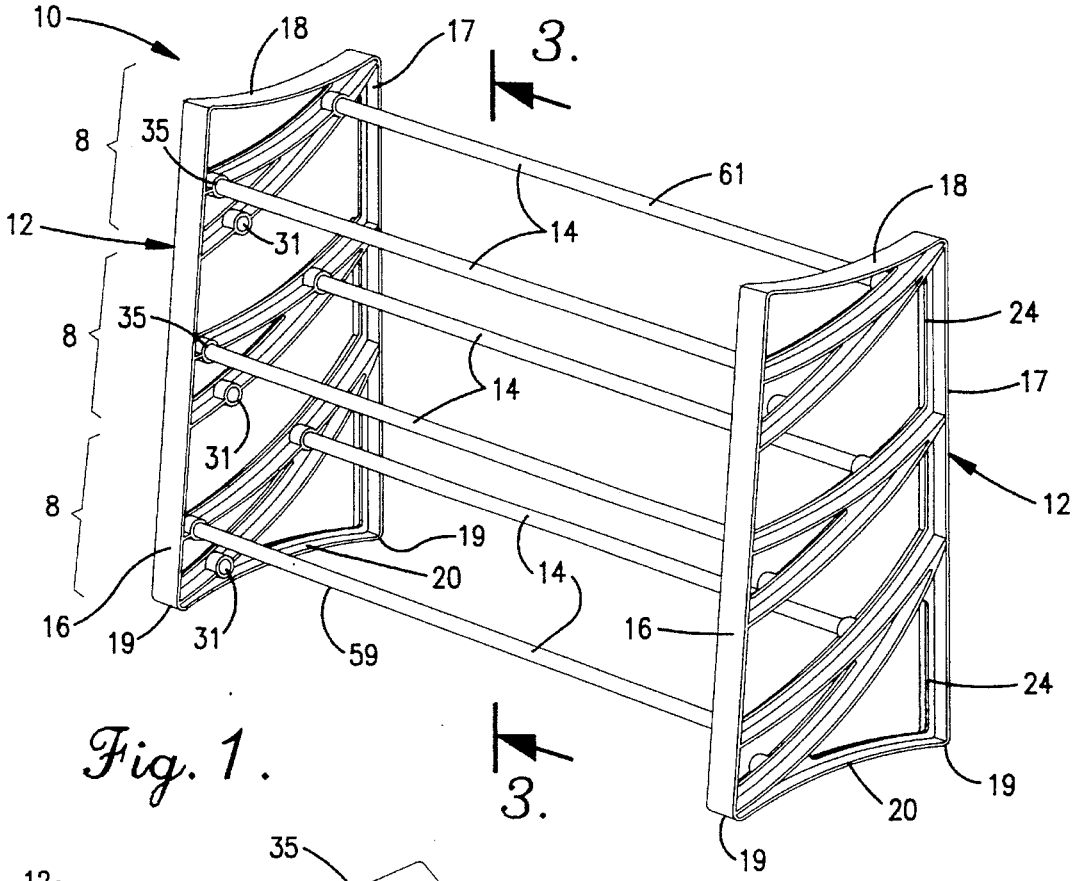
FIG. 1 one is a perspective view of the shoe rack according to the present invention when aligned in a vertical arrangement.

FIG. 1 illustrates a shoe rack according to the present invention generally designated by reference numeral 10. The shoe rack is aligned in a vertical arrangement with a plurality of shoe supporting tiers 8 stacked vertically above one another. The rack 10 includes a pair of side frames 12 which support multiple sets of base members 14 within each tier 8.

The term "base members" is used hereafter to generically refer to all forms of supports which may retain the shoes at a desired pitch within a tier. The base members may include tubes having cross-sections that are circular, triangular, square, cross-shaped, V-shaped, rectangular and the like. The base members may comprise two or more separate parts to support front and back portions of each shoe. Alternatively, the base members may comprise a single platform with multiple supports on opposite ends attached to the side frames 12. The base members and side frames may be formed of structural foam, wood, plastic, steel, fiberglass, and the like.

Each of the side frames 12 may have a generally rectangular configuration. Specifically, each side frame 12 may include a pair of spaced upwardly extending legs 16, 17 maintained in alignment by an upper cross bar 18 connected to the upper end of each leg 16, 17 and a lower cross bar 20 extending between the lower ends of the legs 16, 17.

The upper and lower cross bars 18 and 20 may be curved to extend along an arcuate path to provide feet 19 at the points of contact with the legs 16, 17. The feet 19 provide a solid base for use when set upright in a vertical arrangement (with the longitudinal axis extending in a vertical plane) and resting firmly upon carpet and the like.

The legs 16, 17 and cross bars 18 and 20 may be formed of separate elements which are connected together by adhesives, welding or other known means. However, it is preferred for strength and economy that these elements be formed as monolithic units by plastic molding. Where such plastic material is employed, it may be desirable to form an inwardly extending reinforcing rib 24 which extends about the interior surface of the legs 16 and bars 18 and 20 to encompass the entire interior periphery of the rectangular shape of the side frame 12.

Figure 3:
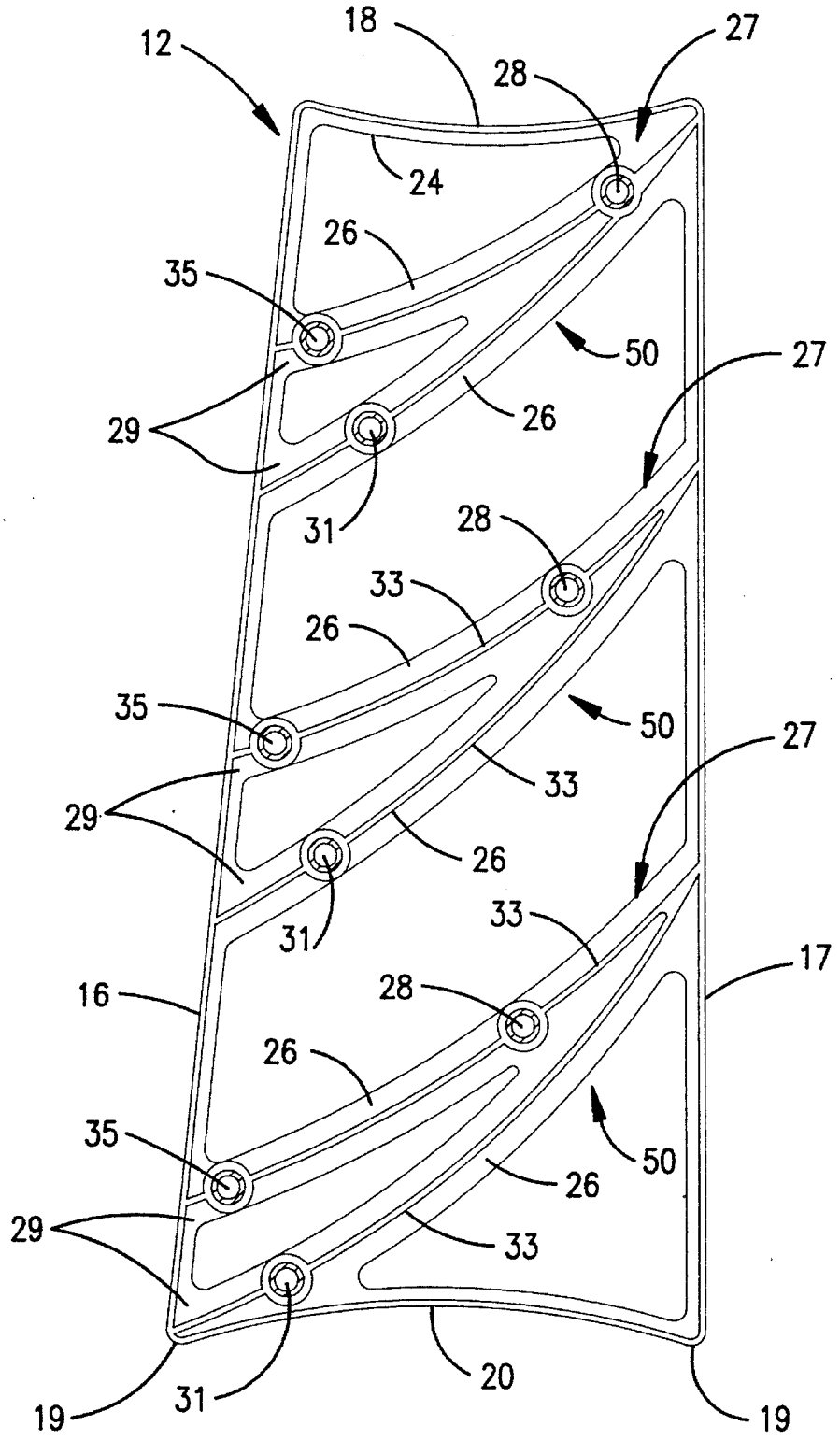
FIG. 3 is a side view of a side frame according to the present invention taken along line 3—3 in FIG. 1.

Turning to FIG. 3, each side frame 12 includes a plurality of support brackets 50 extending between the legs 16, 17 and located above one another (with respect to a vertical orientation of the shoe rack as illustrated in FIG. 1). Each support bracket 50 includes two support bars 26 and at least three base supports or receptacles designated by reference numerals 28, 31 and 35 (discussed in full below), therein to receive corresponding ends of the base members 14. Optionally, the bracket 50 may be a solid piece with any desired configuration which spans between the legs 16, 17. Optionally, the bracket 50 need not span between the legs 16, but instead may comprise flanges extending inward from each leg 16 with the flanges securely retaining the base members 14 in a desired orientation. Optionally, the base receptacles and base members may be varied in any desired manner so long as a base member is attached to the brackets 50 in a convertible manner between horizontal and vertical alignments. The brackets 50 may include a grid configuration. The bracket 50 may be permanently secured to the base member 14, with the bracket 50 being detachably connected with the frame 12 for conversion between horizontal and vertical alignments. For instance, the brackets 50 may be hinged at one end to the side frame 12 and pivoted thereabout to shift the opposite end between first and second positions (along an arcuate path). As the bracket pivots it similarly moves the base members between first and second shoe retaining planes to convert the rack between horizontal and vertical arrangements.

Optionally, each bracket 50 could include different length crossbars which are detachable from its corresponding side frame 12. A different crossbar would be used for each orientation. Hence, the bracket 50 may be fixedly attached to the base member 14 and the bracket 50 moved relative to the side frame 12 to convert the rack between horizontal and vertical orientations.

The support bars 26 extend between the legs 16, 17 at positions intermediate the cross bars 18 and 20. In the preferred embodiment, the support bars 26 are combined in pairs, with each pair forming a V-shaped configuration. The V-shaped pairs of bars are lined with the apex 27 of the V-shaped structure located vertically above the lower or opposite end 29 of each support bar 26. In the preferred embodiment, support bars are formed with a slight curvature to enhance rigidity and to be aesthetically pleasing. Of course, a variety of structures may be substituted for the V-shaped configuration such as a single triangular-shaped piece, or separate support bars or flanges extending inward from both legs 16, 17. The apex 27 of each V-shaped structure includes a base support 28 on one side thereof. Lower ends 29 of the support bars 26 include horizontal and vertical supports 31 and 35. While the supports 28, 31, and 35 may take many configurations, in the preferred embodiment it is preferred that the supports 28, 31, and 35 take the form of cylindrical holes or receptacles which have a diameter sized to frictionally retain the ends of the base members 14.

Figure 2:
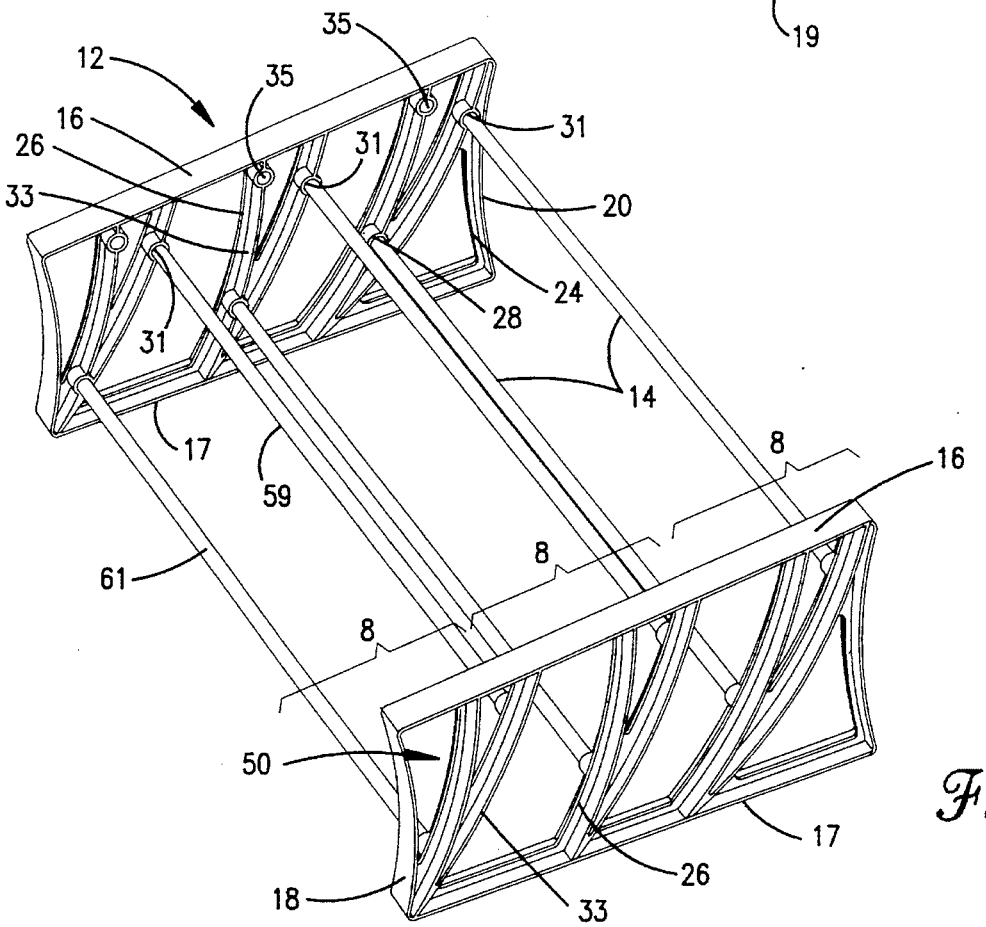
FIG. 2 is a perspective view of a shoe rack according to the present invention when aligned in a horizontal arrangement.

As is best shown in FIG. 2, each of the cylindrical holes which define the supports 28, 31, and 35 are directed inward toward an opposite side frame 12. Optionally, the supports 28, 31, and 35 may include recesses on both sides of the support bars 26 to receive base members 14 in both sides thereof. Each of the supports 28, 31 and 35 include and define a pair of cylindrical cavities which each open outwardly from the plane defined by the legs 16, 17 and cross bars 18 and 20. The cavities will receive the ends of the base members 14, with the end of the base members 14 abutting against the base of the cavity. This abutting relation allows the user to readily place the tubes in the cavities to the proper depth. In a manner similar to the legs and cross bars, it may be necessary to provide the support bar 26 with a centrally disposed reinforcement rib 33. The reinforcement rib 33 may extend from both the top and bottom face or both sides of the support bar 26.

The supports 28, 31, and 35 are separated, within each bracket 50, into a base support 28, a horizontal support 31, and a vertical support 35. The base supports 28 are located proximate a rear or lower (depending upon the rack's orientation) leg 17 of its associated side frame 12, while the horizontal and vertical supports 31 and 35 are located proximate the opposite rear or lower leg 17 of its associated side frame 12. The base support 28 is located vertically above the horizontal and vertical supports 31 and 35 (while the rack is in a vertical orientation), and the vertical support 35 is located above the horizontal support 31.

As shown in FIG. 1, the horizontal support 31 is located further from its associated leg 16 than the vertical support 35. In the preferred embodiment, the horizontal and vertical supports 31 and 35 are located equal distances from the base support 28.

While the supports 28, 31, and 35 are illustrated as circular cavities within the bracket 50, the supports may be modified so long as they provide the desired function. For instance, the supports may include any cross-sectional configuration desirable for the base members 14. Similarly, the pair of base members 14 may be removed and a flat plate substituted therefore with pegs at opposite corners of the plate to be received within the supports. The supports may represent holes extending through the support bracket in order that the side frame may be located at an intermediate point along the base members 14. In this construction, longer base members may be utilized with three or more side frames mounted along a length of base members. The supports may be constructed with an open upper side to allow the support bars to be snappingly inserted in a direction perpendicular to the longitudinal axis of the support bars. Along this line, the horizontal and vertical supports 31 and 35 may be constructed with differing open sides to enable the user to determine which support is to be used depending upon the orientation of the side frames. For instance, if the side frames are oriented in the horizontal position, the horizontal supports 31 would be constructed with an open side directed upward when so aligned. Similarly, the vertical supports 35 would include an open side directed upward when the side frames 12 are aligned in a vertical orientation.

As a further option, the horizontal and vertical supports 31 and 35 may be removed and an arcuate-shaped notch substituted therefor, the notch may have multiple ridges to support the base members 14 at a plurality of locations to allow the user to set the pitch between the shoe base members 14 as desired depending upon the orientation of the rack. Also, the base members 14 may have lateral pins protruding therefrom to be lockingly received within slots on either side of the supports 28, 31, and 35.

The base members 14 which extend between the side frames 12 are preferably formed of steel, aluminum, or other metal sheeting rolled into a tubular form. This will provide sufficient strength to support several pairs of shoes. As shown in the figures, the support bars 26 are preferably extended between the legs 16 at an angle with respect to horizontal such that one of the base members 14 in each pair is higher than the other. This will allow the higher of the base members to support the shoe just forward of the heel, with the toe of the shoe, or at least a forward portion thereof, supported by the lower of the base members. As such, the shoe rack 10 shown in FIG. 1 will provide a stable structure for supporting several pairs of shoes upon three vertical tiers.

During operation, a fixed support bar 61 is mounted within the base support 28 at all times, regardless of the horizontal and vertical orientation of the side frames. An convertible support bar 59 is moved between the horizontal and the vertical supports 31 and 35 depending upon the orientation of the side frames. For instance, when the side frames are aligned in a horizontal position, with the leg 17 (FIG. 2) functioning as a bottom leg, the convertible support bar 59 is mounted in the horizontal supports 31. Alternatively, when the side frame 12 is aligned in a vertical position (FIG. 1) with the lower crossbar 20 located proximate with the floor, the convertible support tube 59 is received within the vertical supports 35. In this manner, the convertible and fixed tubes 59 and 61 are maintained in a desired orientation with respect to each other and are maintained within a substantially constant shoe retaining plane. The convertible and fixed tubes 59 and 61 maintain this plane in order that the shoes are maintained in an optimal orientation within each tier. The preferred shoe retaining plane is preferably between 30°–60° with respect to horizontal and optimally at approximately 50° from horizontal.

As illustrated in FIG. 3, the side legs 16, 17 are mounted to the upper and lower cross bars 18 and 20 to maintain a non-parallel alignment with one another. Upper ends of the legs 16, 17 converge to form a trapezoid-shaped sideframe. As shown in FIG. 3, the base supports 28 are mounted such that the uppermost support is immediately adjacent the side leg 17 forming the bottom when the side frame is aligned in the horizontal position, while the lowermost base support 28 is located more remotely from the side leg 17. This alignment ensures that each tier provides a gradually upward sloping arrangement between the tiers 8 when the rack is horizontally oriented to afford better access to shoes mounted on the rearward tiers.

For additional storage capacity in a lateral direction, an additional pair of base members 14 may be inserted into outwardly opening cylindrical cavities (not shown) of one of the side frames 12. A third side frame would then be mounted to the free end of these additional base members to define a shoe rack which is two units long. It should be noted that while such a shoe rack would be two units long, only three of the side frames 12 need be employed. Additionally, the extended shoe rack will be a single integral unit having greater structural stability.

The side frames 12 according to the present invention may optionally be provided with interlocking structure such that the shoe racks may be stacked one upon the other in a stable manner to provide further storage capacity.

In particular, the upper cross bar 18 may include a centrally located and upwardly extending interlock rib. The rib would extend the full length of the upper cross bar 18. Alternatively, the interlock rib may be formed as a plurality of members having lesser length, such as a pair of ribs spaced along the length of the cross bar 18.

While the present invention has been described with reference to a specific embodiment, it should be noted that various modifications may be made without departing from the spirit of the invention. For example, different materials or reinforcement rib arrangements may be employed. Additionally, the base members 14 need not be of a fixed length, but may be telescopic to provide further flexibility, as is known in the art. Further, a single tier may be included and the side frames may have any desired configuration.

From the foregoing it will be seen that this invention is one well adapted to attain all ends and objects hereinabove set forth together with the other advantages which are obvious and which are inherent to the structure.

It will be understood that certain features and subcombinations are of utility and may be employed without reference to other features and subcombinations. This is contemplated by and is within the scope of the claims.

Since many possible embodiments may be made of the invention without departing from the scope thereof, it is to be understood that all matter herein set forth or shown in the accompanying drawings is to be interpreted as illustrative, and not in a limiting sense.

What is claimed is:

1. A shoe rack comprising:

at least one base member for engaging and retaining shoes within a shoe retaining plane having a desired pitch with respect to horizontal; and side frames formed along parallel longitudinal axes, each side frame including at least one side leg extending along a length of the frame; and at least one support bracket mounted to said at least one side leg, each support bracket supporting a corresponding end of said base member, one of said base member and said support bracket including convertible means for affixing said base member in first and second positions with respect to said side frames when said side frames are converted between horizontal and vertical alignments, respectively, said convertible means maintaining said base member in one of said first and second positions to maintain said shoe retaining plane at said desired pitch with respect to horizontal when the shoe rack is converted between said horizontal and vertical alignment.

2. A shoe rack, according to claim 1, wherein said support bracket includes at least three base supports.

3. A shoe rack, according to claim 1, wherein said convertible means includes three base supports aligned in a triangular arrangement within the support bracket.

4. A shoe rack according to claim 1, wherein a base member includes two support tubes and said convertible means includes three tube supports, from which a first pair receive one end of corresponding support tubes when in a horizontal alignment.

5. A shoe rack according to claim 4, wherein said pair of base members are received within a second pair of said three tube supports when said pair of frames is aligned in a vertical alignment.

6. A shoe rack according to claim 4, wherein first pairs of said three tube supports on corresponding side frames retain a pair of base members within a first plane forming a first acute angle with respect to said longitudinal axes of said side frames.

7. A shoe rack according to claim 6, wherein second pairs of said at least three tube supports on corresponding side frames retain said pair of base members within a second plane forming a second acute angle with respect to said longitudinal axes of said side frames.

8. A shoe rack according to claim 1, wherein said longitudinal axes of the side frame is aligned substantially horizontally when in said horizontal alignment and substantially vertically when in said vertical alignment.

9. A shoe rack according to claim 2, wherein a first base support retains a first base member when said pair of side frames is aligned in said horizontal and vertical alignments and wherein second and third base supports alternately retain a second base member when said pair of side frames is aligned in said horizontal and vertical alignments, respectively.

10. A shoe rack according to claim 2, wherein second and third base supports are included within a first and second combination, respectively, said second and third base supports retaining a second base member when said side frames are aligned in said horizontal and vertical alignments, respectively.

11. A shoe rack according to claim 1, wherein side legs in each side frame are mounted to one another in a non-parallel alignment with first ends of the legs located closer to one another than second ends of the legs.

12. A shoe rack according to claim 1, wherein each side frame includes upper and lower legs with front and rear ends when positioned in said horizontal alignment along a horizontal axis, and wherein said base member includes at least two pair of base members, each pair having a bottom tube proximate said lower leg and a top tube proximate said upper leg, wherein each support tube within a tube pair proximate said rear end of the legs is located vertically above corresponding base members within a tube pair proximate said front end of the legs.

13. A shoe rack according to claim 1, wherein said support bracket is fixedly mounted to a corresponding side frame, and wherein said base member is detachably mounted at first and second positions to the support frame to affix said base member in first and second positions with respect to the side frames.

14. A shoe rack for storing multiple pairs of shoes, said rack being converted between substantially vertical and horizontal axes, said rack comprising:

a pair of frames convertible between horizontal and vertical orientations;

support means, extending between said side frames, for forming a shoe retaining plane and for supporting shoes at a predefined angle with respect to horizontal; and mounting means, attached to each said frame, for ajustably mounting said support means to said side frames, said mounting means being adjusted to maintain the support means at substantially said shoe retaining plane, for supporting shoes at substantially said predefined angle, when said rack is converted between said vertical and horizontal orientations.

15. A shoe rack according to claim 14, wherein mounting means maintains said shoe retaining plane at a constant acute angle with respect to a longitudinal axis of said side frame when said side frames are converted between said horizontal and vertical orientations.

16. A shoe rack according to claim 14, wherein said support means is a support tube and said mounting means mounts said support tube at a first point to the side frames when in said horizontal orientation and mounts said support tube at a second point to the side frames when in said vertical orientation.

17. A shoe rack according to claim 14, wherein said support means includes at least two base members within each tier.

18. A shoe rack according to claim 14, wherein said mounting means includes side brackets having a plurality of supports therein aligned to receive said support means in one of first and second alignments with respect to a longitudinal axis of said side frames based on an orientation of the side frames.

19. A shoe rack according to claim 14, wherein said support means includes sets of base members and said mounting means mounts at least two sets of base members to the side frame oriented with a rear set of base members, proximate a rear of the rack, being vertically above a front set of base members, proximate a front of the rack, when the side frames are oriented horizontally, said front set of base members being located vertically above the rear set of base members when the side frames are oriented vertically.

* * * * *